US006267570B1

(12) United States Patent
Armando

(10) Patent No.: US 6,267,570 B1
(45) Date of Patent: Jul. 31, 2001

(54) PERISTALTIC PUMP

(76) Inventor: Arne D. Armando, P.O. Box 8, Danville, CA (US) 94526

( * ) Notice: Subject to any disclaimer, the term of this patent is extended or adjusted under 35 U.S.C. 154(b) by 0 days.

(21) Appl. No.: 09/251,001

(22) Filed: Feb. 16, 1999

(51) Int. Cl.[7] ..... F04B 43/08; F04B 43/06
(52) U.S. Cl. ..... 417/478
(58) Field of Search ..... 417/478, 269

(56) References Cited

U.S. PATENT DOCUMENTS 4,365,943 12/1982 Durrum .
5,033,943 7/1991 Durrum et al. .
5,064,358 11/1991 Calari .
5,620,313 4/1997 Fockenberg .

FOREIGN PATENT DOCUMENTS

1910436 * 9/1970 (DE) .

* cited by examiner

*Primary Examiner*—Teresa Walberg
*Assistant Examiner*—Vinod D. Patel
(74) *Attorney, Agent, or Firm*—Theodore J. Bielen, Jr.

(57) ABSTRACT

A peristaltic pump utilizing a fluid inlet from a source of fluid which communicates with a flexible conduit. The flexible conduit is compressed utilizing a motor which rotates a shaft. An eccentric member is locked to the shaft and contacts the inner race of a bearing which is circumferentially located relative to the eccentric member. The outer race of the bearing contacts a lifter which squeezes the conduit against a fixed plate. A check valve arrangement assures flow through the conduit in one direction.

14 Claims, 2 Drawing Sheets

PERISTALTIC PUMP

BACKGROUND OF THE INVENTION

Peristaltic pumps have been devised to provide a steady flow of fluid through a conduit by pressing a member along the length of the conduit. In the past, moveable members have been rolled along the length of the conduit to squeeze fluid from the same in aliquot amounts. For example, U.S. Pat. Nos. 5,064,358 and 5,620,313 describe this type of peristaltic pump. Unfortunately, such peristaltic pumps have suffered from low pressure outputs and pulses or surges which render such pumps as unsuitable for analytical, preparatory or other uses.

U.S. Pat. Nos. 4,365,943 and 5,033,943 show peristaltic pumps having low flow rates which utilize a rotating shaft to turn a cam that either directly or indirectly contacts a plurality of flexible conduits sequentially. In either case a relatively small portion of such flexible conduits are deformed to produce the flow.

A peristaltic pump which exhibits high flow rate characteristics and eliminates surge would be a notable advance in the field of mass transport.

SUMMARY OF THE INVENTION

In accordance with the present invention a novel and useful peristaltic pump for delivery of fluid from a source is herein provided.

The pump of the present invention utilizes a fluid inlet which passes fluid from a source such as a reservoir. The fluid inlet communicates with a flexible conduit having an elongated dimension. Such flexible conduit further includes a fluid outlet. In many cases, a plurality of flexible conduits may be employed and are located in spaced relationship from one another.

Compressing means is also used for pressing the flexible conduit or conduits. Such compressing means utilizes a motor and a shaft which is axially rotated by the motor. A first eccentric member is locked to the rotating shaft, and a plate is located adjacent the flexible conduit. In opposition to the plate is a conduit lifter which is capable of being positioned adjacent the flexible conduit and being moved toward and away from the flexible conduit. The conduit lifter, thus, sandwiches or squeezes the flexible conduit to the stationary plate to cause flow of fluid through the flexible conduit. A first bearing having an inner race contacts the first eccentric member. The outer race of the first bearing engages the conduit lifter. Thus, rotation of the eccentric member moves the bearing into contact with the conduit lifter to squeeze the conduit during certain portions of rotation of the shaft of the motor. Such squeezing or collapse of the flexible conduit, in part, against the plate causes fluid to flow through the conduit. Check valve means directs flow of the fluid in one direction.

In certain embodiments of the present invention, the conduit lifter may include at least one protuberance which extends toward and contacts the outer race of the first bearing. Where a second bearing is employed, the conduit lifter may include a second protuberance contacting the outer race of the second bearing. In such a case, the second bearing would also be located in circumferential relationship with a second eccentric member locked to the shaft of the motor. Thus, a pair of bearings would operate a single conduit lifter to cause flow through the conduit in this embodiment.

In addition, where a second flexible conduit is employed in the present invention, the first eccentric member may support at least another, or third, bearing which would contact a second conduit lifter radially separated about the axis of the shaft from the first conduit lifter. Separation between the flexible conduits and associated lifters may be determined in order to pump fluid through the second conduit when the first conduit has already begun discharging of fluid. Thus, a continuous flow of fluid is obtained from the pump of the present invention. In addition, more than two conduits may be employed in the present invention in sequential fashion, each conduit being operated by a single shaft and by both eccentric members. Again, bearings may independently contact each conduit lifter associated with each flexible conduit about the axis of rotation of the shaft of the motor. Locking collars may hold the multiple bearings location relative to each of the eccentric members. Locking collars may also be located about the motor shaft and about the outer surface of any of the eccentric members.

It may be apparent that a novel and useful peristaltic pump has been described hereinabove.

It is therefore and object of the present invention to provide a peristaltic pump for delivery of fluid from a source that utilizes a multiplicity of flexible conduits which are sequentially activated to produce steady flow of fluid.

Another object of the present invention is to provide a peristaltic pump for delivery of fluid from a source which is capable of delivery of fluid at relatively high pressures.

Another object of the present invention is to provide a peristaltic pump for delivery of fluid from a source which greatly eliminates surge or pulsation associated with the flow of fluid from peristaltic pumps of the prior art.

A further object of the present invention is to provide a peristaltic pump which utilizes multiple eccentric members located on a shaft to operate a single conduit lifter in order to maximize the volume of flow therefrom.

Yet another object of the present invention is to provide a peristaltic pump which is sturdy and may be employed in rugged environments.

Another object of the present invention is to provide a peristaltic pump which is extremely durable at high speeds of operation.

Another object of the present invention is to provide a peristaltic pump that may be simply retrofitted with components to alter flow rate and pressure parameters of operation.

The invention possesses other objects and advantages especially as concerns particular characteristics and features thereof which will become apparent as the specification continues.

For a better understanding of the invention reference is made to the following detailed description of the preferred embodiments thereof which should be taken in conjunction with the prior described drawings.

DETAILED DESCRIPTION OF THE PREFERRED EMBODIMENTS

Various aspects of the present invention will evolve from the following detailed description of the preferred embodiments which should be referenced to the hereinbefore delineated drawings.

Figure 1:
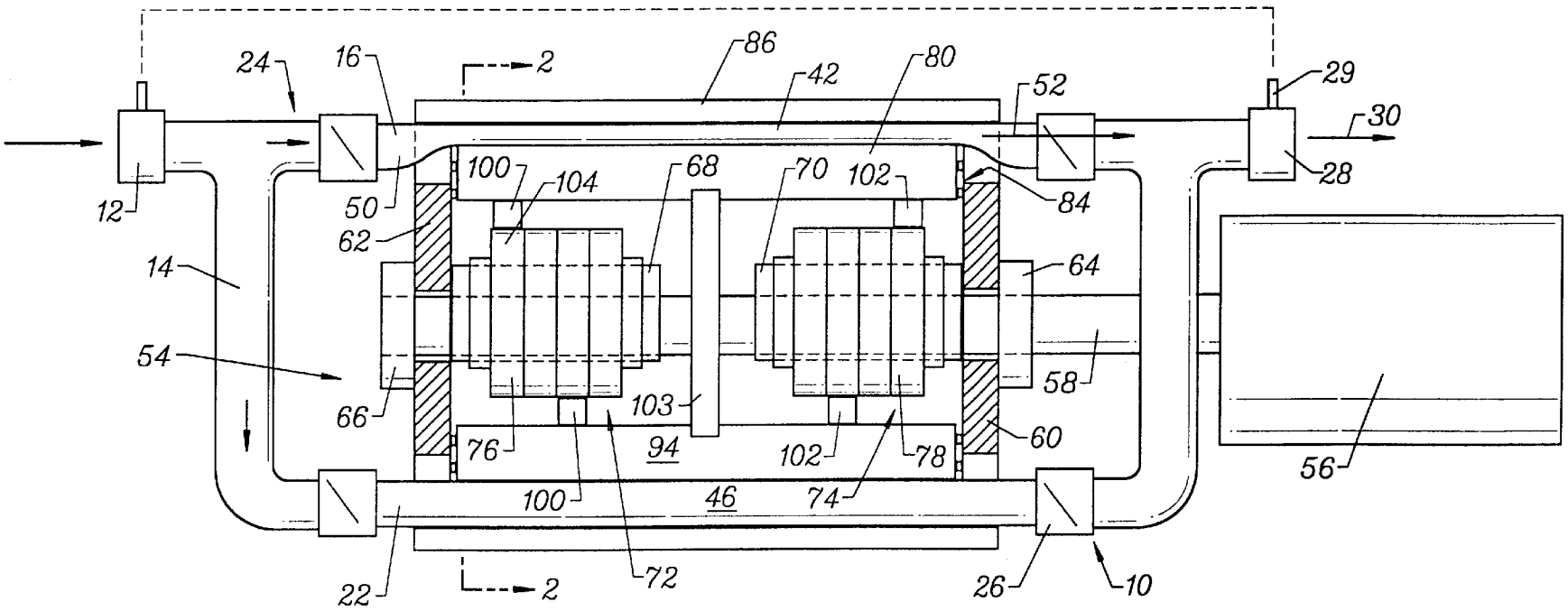
FIG. 1 is a side elevational view of the embodiment of the present invention with a portion of the lifter supports shown in section.
Figure 3:
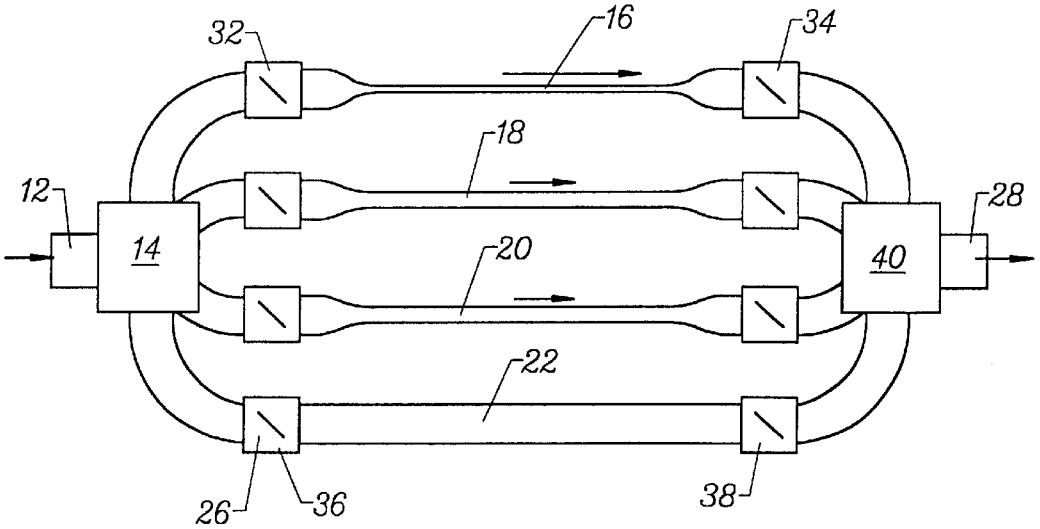
FIG. 3 is a top plan schematic view of the flow pattern of the pump depicted in the prior figures.

The invention as a whole is depicted in the drawings by reference character 10. The peristaltic pump 10 includes as one of its elements a fluid inlet 12 which may feed from a fluid reservoir (not shown). Fluid inlet 12 flows through a manifold 14 which essentially splits fluid inlet 12 into multiple streams. In the embodiment 10 depicted in FIGS. 1–3, fluid inlet 12 has been split into four separate streams, 16, 18, 20, and 22, shown schematically in FIG. 3. FIG. 1 depicts fluid streams 16 and 22 most clearly. Directional arrows 24 illustrate the split of inlet stream 12. Check valve means 26 insures the flow of fluid from inlet 12 from outlet 28 in one direction through the action of pump 10. This operation will be described in greater detail hereinafter. Directional arrow 30 shows the flow of fluid from pump 10, in this regard. Again, FIG. 3 depicts check valve means 26, schematically, with respect to fluid stream 16, 18, 20, and 22. That is to say, check valves 32 and 34 are associated with fluid stream 16, while check valves 36 and 38 are associated with fluid stream 22. Similar check valves operate with respect to fluid streams 18 and 20. Manifold 40 combines the flow from fluid stream 16, 18, 20, and 22 into fluid outlet 28. Eductor 29 may connect inlet 12 with outlet 28, to allow a small portion of outlet fluid to travel back to the inlet stream. Eductor 29 permits pump 10 to run at high speeds, which will be discussed more fully hereinafter.

Figure 2:
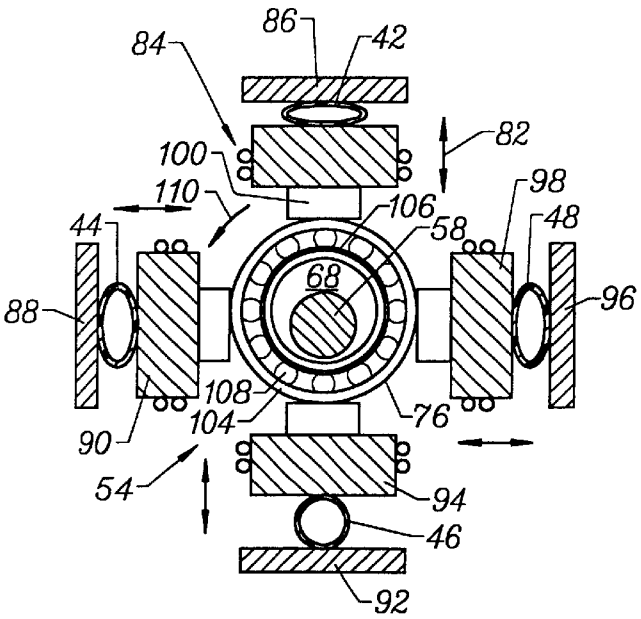
FIG. 2 is a sectional view showing the sequential operation of the peristaltic pump of FIG. 1 taken along line 2—2 of FIG. 1.

Each fluid stream, 16, 18, 20, and 22 has an associated flexible conduit. Turning to FIG. 2, it may be observed that flexible conduits 42, 44, 46, and 48 are associated with fluid streams 16, 18, 20, and 22, respectively. For the sake of clarity, FIG. 1 depicts flexible conduits 42 and 46 most clearly. Flexible conduits 42 and 46 are elongated and communicate with fluid inlet 12 as well as fluid outlet 28. Thus, exemplary conduit 42 includes a fluid inlet portion 50 and a fluid outlet portion 52. The same relationship exists with respect to flexible conduits 44, 46, and 48. Each conduit may range in size from 1 inch to 5 inches in diameter and be able to withstand pressure up to 2,500 psi. For example, conduits 42, 44, 46, and 48 may take the form of industrial hoses composed of elastomeric material having multiple high tensile strength steel belts imbedded within the hose wall.

Compressing means 54 is utilized to sequentially press or collapse conduits 40, 42, 44, 46, and 48. It may be apparent from FIG. 1 that compressing means utilizes a motor 56 which may be operated electrically, through an internal combustion mechanism, by manual means, and the like. In any case, motor 56 rotates the output shaft 58. Shaft 58 is held to journals 60 and 62 and maintained in this position by supports 64 and 66.

Locked to shaft 58 are a pair of eccentric members 68 and 70, which necessarily, rotate with shaft 58. A plurality of bearings 72 and a plurality of bearings 74 are associated with first eccentric member 68 and second eccentric member 70, respectively. Turning to FIG. 2, it may be seen that bearings 76 and 78 are employed to collapse or squeeze flexible conduit 42. In such a case, compressing means 54 takes the form of a conduit or hose lifter 80 which is movable upwardly and downwardly according to directional arrow 82, FIG. 2. A plurality of rollers 84 fixed to journals 60 and 62 allow lifter 80 to move up and down. It should be noted that a fixed plate 86 lies in opposition to conduit lifter 80 to effect the squeezing or collapsing of conduit 42, best shown in FIGS. 1 and 2. Consequently, plate 88 and lifter 90 collapse conduit 44, plate 92 and lifter 94 collapse conduit 46, and plate 96 and lifter 98 collapse conduit 48, in a sequential manner as shaft 58 turns. Although the actual mechanism for such squeezing or collapsing has been thoroughly discussed with respect to conduit 42 and it should be understood that a similar mechanism applies to the squeezing of the remaining conduits. Eductor 29 allows conduits 42, 44, 46, and 48 to quickly expand with fluid and rebound from a collapsed state when pump 10 runs at elevated speeds.

Conduit lifter 80 is provided with a pair of protuberances or blocks 100 and 102 which contact the outer races of bearings 76 and 78. Viewing again, FIG. 2, bearing 76 is shown in greater detail, in which outer race 104 rotates relative to inner race 106. Plurality of ball bearings 108 lie in between outer race 104 and inner race 106. Blocks 100 and 102 allow the use of lifter 80 against elongated portion of conduit 42, which maximizes the flow of fluid therefrom. It should be further seen that bar 103 may be employed to connect lifters 80 and 94 together. It has been found that multiple bearing sets acting on individual lifters reduce friction, conserving energy, and prolong the life of the moving components of pump 10.

In operation, with respect to conduit 42 and compressing means 54 associated therewith, motor 56 turns shaft 58 and eccentric member 68 locked thereto. Bearings 76 and 78 are moved upwardly, in FIG. 2, such that the outer races of such bearings, including outer race 104 of bearing 76, contact block 100 and block 102 formed on conduit lifter 80. When this occurs, lifter 80 squeezes conduit 42 against plate 86 such that fluid flows from conduit 42 according to directional arrow 30 through outlet 28. The direction of such flow is due to check valve means 26. As shaft 58 turns according to directional arrow 110, lifter 80 retreats toward shaft 58 and lifter 90 begins to collapse or squeeze conduit 44. At this point, conduit 46 is in its fully extended position between lifter 94 and plate 92. However, when shaft 58 continues to turn, conduit 46 will be collapsed between lifter 94 and plate 92 to force liquid from conduit 46 through outlet 28. The sequential collapsing of conduits 42, 44, 46, and 48 produces a high volume steady flow of fluid through outlet 28. Following collapse, each conduit 42, 44, 46, and 48 quickly expand due to the elastomeric material and the high tensile strength steel embedded in the conduit wall. Eductor 29 also aids in this endeavor. Pump 10 may be easily retrofitted with hoses, lifters, bearings, and the like, to meet particular operation demands of flow rate and pressure.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A peristaltic pump for delivering fluid from a source, comprising:

a. a fluid inlet, said fluid inlet passing fluid from the source;

b. a first flexible conduit having an elongated dimensions said first flexible conduit being connected to and communicating with said fluid inlet, said first flexible conduit further including a fluid outlet;

c. a second flexible conduit having an elongated dimension, said second flexible conduit being connected to said fluid inlet, said second flexible conduit further including a fluid outlet, said second flexible conduit being spaced from said first flexible conduit;

d. compressing means for pressing said flexible conduit, said compressing means comprising a motor, a shaft axially rotated by said motors at least a first eccentric member locked to said rotating shaft, a first plate located adjacent said first flexible conduit and a first conduit lifter located adjacent said first flexible conduit and in opposition to said first plate, a second plate located adjacent said second flexible conduit, and a second conduit lifter located adjacent said second flexible conduit and in opposition to said second plate, said first conduit lifter contacting only said first flexible conduit along said elongated dimension of said first flexible conduit, said second conduit lifter contacting only said second flexible conduit along said elongated dimension of said second flexible conduit, a first bearing, said first bearing having an inner race contacting said first eccentric member and an outer race contacting said first conduit lifter to move said first conduit lifter and for directing a force against said first flexible conduit to at least partially collapse said first flexible conduit against said first plate during one portion of the axial rotation of said shaft, and a second bearing, said second bearing having an inner race contacting said first eccentric member and an outer race contacting said second conduit lifter to move said second conduit lifter and for directing a force against said second flexible conduit to at least partially collapse said second flexible conduit against said second plate during one portion of the axial rotation of said shaft; and d. check valve means to direct fluid in one direction in said first and second flexible conduits.

2. The pump of claim 1 in which said conduit lifter further comprises a protuberance extending toward said outer race of said first bearing.

3. The pump of claim 1 in which said compressing means further comprises a second eccentric member locked to said rotating shaft and spaced from said first eccentric member, a second bearing, said second bearing having an inner race contacting said second eccentric member and an outer race contacting said conduit lifter simultaneously with said contact of said conduit lifter by said outer race of said first bearing.

4. The pump of claim 3 in which said conduit lifter further comprises a first protuberance extending toward and contacting said outer race of said first bearing and a second protuberance extending toward and contacting said outer race of said second bearing.

5. The pump of claim 4 which further comprises a pair of locking collars at least partially surrounding said shaft and supporting said first bearing to said first eccentric member locked to said rotating shaft.

6. The pump of claim 5 in which said conduit lifter further comprises track means for guiding said movement of said conduit lifter.

7. The pump of claim 1 in which said flexible conduit is a first flexible conduit and which further comprises a second flexible conduit, having an elongated dimension, communicating with said fluid inlet, said second flexible conduit further including a fluid outlet, said plate is a first plate and further includes a second plate located adjacent said second flexible conduit, said conduit lifter is a first conduit lifter and further includes a second conduit lifter contacting said second flexible conduit along said elongated dimension of said second flexible conduit, a third bearing having an inner race contacting said first eccentric member locked to said rotating shaft, and an outer race contacting said second conduit lifter, said outer race of said third bearing moving said second conduit lifter to at least partially collapse said second flexible conduit against said second plate during another portion of the axial rotation of said shaft, and said check valve means directing fluid in one direction in said second flexible conduit.

8. The pump of claim 7 in which said first conduit lifter further comprises a protuberance extending toward said outer race of said first bearing.

9. The pump of claim 8 in which said compressing means further comprises a second eccentric member locked to said rotating shaft and spaced from said first eccentric member, a second bearing, said second bearing having an inner race contacting said second eccentric member and an outer race contacting said first conduit lifter simultaneously with said contact of said first conduit lifter by said outer race of said first bearing.

10. The pump of claim 9 in which said protuberance is a first protuberance and which further comprises a second protuberance extending toward and contacting said outer race of said second bearing.

11. The pump of claim 10 which further comprises a pair of locking collars at least partially surrounding said shaft and supporting said first and third bearings to said first eccentric member locked to said rotating shaft.

12. The pump of claim 11 which further comprises a manifold receiving said fluid outlets of said first and second flexible conduits.

13. The pump of claim 1 which further includes an eductor conduit communicating with said fluid inlet and said fluid outlet.

14. A peristaltic pump for delivering fluid from a source, comprising:

a. a fluid inlet, said fluid inlet passing fluid from the source;

b. a first flexible conduit having an elongated dimension, said first flexible conduit being connected to and communicating with said fluid inlet, said first flexible conduit further including a fluid outlet;

c. a second flexible conduit having an elongated dimension, said second flexible conduit being connected to said fluid inlet, said second flexible conduit further including a fluid outlet, said second flexible conduit being spaced from said first flexible conduit;

d. compressing means for pressing said flexible conduit, said compressing means comprising a motor, a shaft axially rotated by said motor, a first eccentric member locked to said rotating shaft, a second eccentric member locked to said rotating shaft, a first plate located adjacent said first flexible conduit and a first conduit lifter located adjacent said first flexible conduit and in opposition to said first plate, a second plate located adjacent said second flexible conduit, and a second conduit lifter located adjacent said second flexible conduit and in opposition to said second plate, said first conduit lifter contacting only said first flexible conduit along said elongated dimension of said first flexible conduit, said second conduit lifter contacting only said second flexible conduit along said elongated dimension of said second flexible conduit, a first bearing, said first bearing having an inner race contacting said first eccentric member and an outer race contacting said first conduit lifter to move said first conduit lifter and for directing a force against said first flexible conduit to at least partially collapse said first flexible conduit against said first plate during one portion of the axial rotation of said shaft, and a second bearing, said second bearing having an inner race contacting said second eccentric member and an outer race contacting said second conduit lifter to move said second conduit lifter and for directing a force against said second flexible conduit to at least partially collapse said second flexible conduit against said second plate during one portion of the axial rotation of said shaft; and d. check valve means to direct fluid in one direction in said first and second flexible conduits.

* * * * *